US008408951B1

(12) United States Patent
Chartrand

(10) Patent No.: US 8,408,951 B1
(45) Date of Patent: Apr. 2, 2013

(54) BATTERY CONTACT FOR AN ELECTRONIC DEVICE

(75) Inventor: Mathieu Chartrand, Lery (CA)

(73) Assignee: Winvic Sales Inc., Ontario (CA)

( * ) Notice: Subject to any disclaimer, the term of this patent is extended or adjusted under 35 U.S.C. 154(b) by 0 days.

(21) Appl. No.: 13/253,432

(22) Filed: Oct. 5, 2011

(51) Int. Cl.
*H01R 4/28* (2006.01)
*F21L 4/02* (2006.01)

(52) U.S. Cl. ..... 439/754; 362/204

(58) Field of Classification Search ..... 362/204, 362/205, 190, 109, 392; 439/754
See application file for complete search history.

(56) References Cited

U.S. PATENT DOCUMENTS 1,377,646 A * 5/1921 Wellington ..... 362/204
1,432,164 A * 10/1922 Drufva ..... 362/204
1,609,583 A * 12/1926 Sokolow ..... 362/202
2,469,163 A * 5/1949 Gilmore ..... 431/290
3,614,279 A * 10/1971 Schenke ..... 431/17
4,680,683 A * 7/1987 Schenke et al. ..... 362/190
5,558,430 A * 9/1996 Booty, Jr. ..... 362/184
6,074,778 A * 6/2000 Stagakis ..... 362/202
6,398,383 B1 * 6/2002 Huang ..... 362/202
7,152,854 B2 * 12/2006 Uchida ..... 267/178
2004/0095758 A1 * 5/2004 Hsien ..... 362/204
2006/0072310 A1 * 4/2006 Hung ..... 362/205
2007/0133201 A1 * 6/2007 Lui ..... 362/205
2007/0223238 A1 * 9/2007 Jensen ..... 362/392

* cited by examiner

*Primary Examiner* — Briggitte R Hammond
(74) *Attorney, Agent, or Firm* — McAndrews, Held & Malloy, Ltd.

(57) ABSTRACT

According to embodiments of the present invention, an electronic device includes a first electrical conductor located in a shell. The first electrical conductor has a vertical portion and a horizontal portion at the bottom of the vertical portion. A cap has a second electrical conductor and can be mated with the shell. After mating, the second electrical conductor contacts the horizontal portion of the first electrical conductor.

15 Claims, 3 Drawing Sheets

BATTERY CONTACT FOR AN ELECTRONIC DEVICE

RELATED APPLICATIONS

[Not Applicable]

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

Generally, the present application relates to battery contacts for electronic devices. Electronic devices, such as a flameless candle or flashlight, may use batteries for power. An electronic device may have a housing including a hollow interior region that houses one or more batteries. As used here, the term batteries can mean one battery or a plurality of batteries. Similarly, the term battery can mean one battery or a plurality of batteries. The electronic device may also have a cap (for example, completely removable, partially removable, detachable, etc.) to keep the batteries in the housing. One terminal of the battery (positive terminal, for example) may contact an electronics portion. The other terminal of the battery (negative terminal, for example) may be distal from the electronics portion.

Different techniques may be used to make contact with the distal terminal and thus complete a circuit so that the electronics portion may operate. One technique is to construct the housing with a conductive material such as metal. However, using such conductive materials may be relatively expensive as compared, for example, to some plastics. Another technique is to have a conductor within the hollow interior region that makes an electrical connection with both the electronics portion and a conductor on the cap or bottom. However, such existing techniques may be prone to failure.

Therefore, it may be useful to have a conductor that includes a battery terminal contact to reliably maintain a connection with a distal terminal of a battery.

BRIEF SUMMARY OF THE INVENTION

According to embodiments of the present invention, a flameless candle an electronic device includes a shell, a first electrical conductor, and a cap. The shell has an opening that receives one or more batteries into a hollow interior region.

The first electrical conductor is located (at least partially) within the shell. The first electrical conductor has a vertical portion and a horizontal portion at the bottom of the vertical portion. The horizontal portion may have one or more loops. The first electrical conductor may be one piece of solid wire.

The cap has a second electrical conductor and mates with the shell through the opening. For example, the cap may have male threads that mate with female threads on the shell. When the cap is mated with the shell, the second electrical conductor contacts the horizontal portion of the first electrical conductor. The second electrical conductor may include a spring that contacts a battery terminal when the cap is mated The inner wall of the shell may have a groove that receives the vertical portion of the first electrical conductor. Also, the inner wall of the shell may have a projecting portion which is located above the horizontal portion of the first electrical conductor. When the cap is mated with the shell, the second electrical conductor and the projecting portion may compress the horizontal portion. The second electrical conductor may include a recessed area and a rim. In such a case, the rim would compress and contact the horizontal portion of the first electrical conductor.

The flameless candle may also include an electronics portion connected to the top of the vertical portion of the first electrical conductor. The electronics portion may include a lamp (for example, an LED).

According to embodiments of the present invention, an electronic device includes a first electrical conductor located in a shell. The first electrical conductor has a vertical portion and a horizontal portion at the bottom of the vertical portion. A cap has a second electrical conductor and can be mated with the shell. After mating, the second electrical conductor contacts the horizontal portion of the first electrical conductor.

The horizontal portion of the first electrical conductor may have a plurality of loops. The second electrical conductor of the cap may have a spring configured to contact a battery terminal when the cap is mated with the shell. The inner wall of the shell may have a projecting portion. When the cap is mated with the shell, the horizontal portion of the first electrical conductor may be compressed between the projecting portion and the second electrical conductor of the cap. The second electrical conductor may include a recessed area and a rim, and the rim may compress the horizontal portion of the first electrical conductor. The inner wall of the shell may have a groove that receives the vertical portion of the first electrical conductor.

Figure 1A:
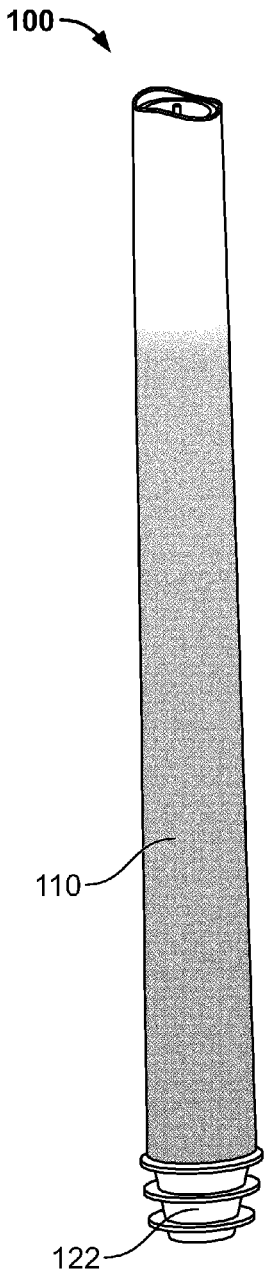
FIG. 1A shows a side view of a flameless candle, according to an embodiment of the present invention.

The foregoing summary, as well as the following detailed description of certain embodiments of the present invention, will be better understood when read in conjunction with the appended drawings. For the purposes of illustration, certain embodiments are shown in the drawings. It should be understood, however, that the claims are not limited to the arrangements and instrumentality shown in the attached drawings. Furthermore, the appearance shown in the drawings is one of many ornamental appearances that can be employed to achieve the stated functions of the system.

DETAILED DESCRIPTION OF THE INVENTION

Figure 1B:
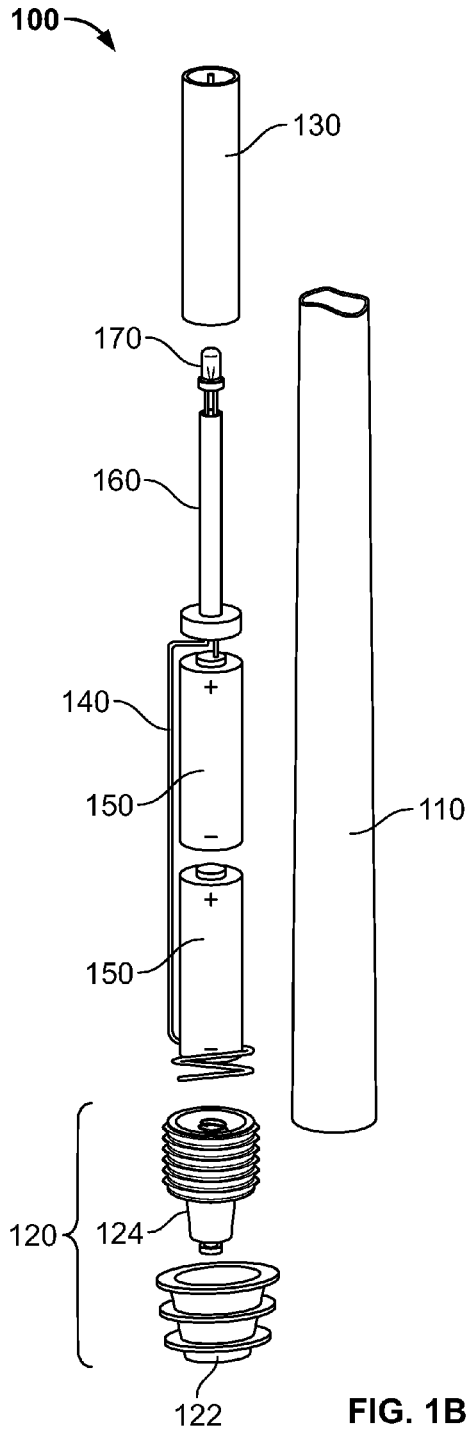
FIG. 1B shows an exploded view of a flameless candle, according to an embodiment of the present invention.

FIGS. 1A and 1B show a flameless candle 100, according to an embodiment of the present invention. The flameless candle 100 may include a shell 110, a cap 120, an insert 130, a first electrical conductor 140, one or more batteries 150, a separation portion 160, a lamp 170 (for example, LED), and a wick (for example, simulated wick).

The shell 110 may be made of a wax or waxen material. The housing 110 may have a hollow interior region to house the batteries 150 (for example, two batteries in series). The shell 110 may also have a compartment to house the separation portion 160, the lamp 170, or the insert 130. The shell 110 may have an opening (for example, through the bottom) to receive the batteries 150. A mating portion (for example, female threads) may also be located near the bottom of the shell 110 to mate with the cap 120. The shell 110 may include a sidewall that may be formed of or include a waxen material.

The separation portion 160 may separate the lamp 170 (for example, an LED) from a terminal of one of the batteries 150. The separation portion 160 may accommodate one or more conductors to provide power to the lamp 170. The separation portion 160 or the lamp 170 may also accommodate additional electronics (for example, a flickering circuit, a current limiting resistor, etc.) for the candle 100. Thus, the lamp 170 may be part of an electronics portion.

The first conductor 140 may be located at least partially in the shell 110. The first conductor 140 may extend from the separation portion 160 or electronics portion including a lamp 170 and past the distal battery terminal. The first conductor 140 may extend through the separation portion and to the lamp 170. For example the first conductor 140 may be directly soldered or connected to one of the leads of the lamp 170.

The cap 120 may mate with the shell 110 through the opening in the shell. The cap 120 may include a second conductor as will be explained in more detail below.

Figure 2:
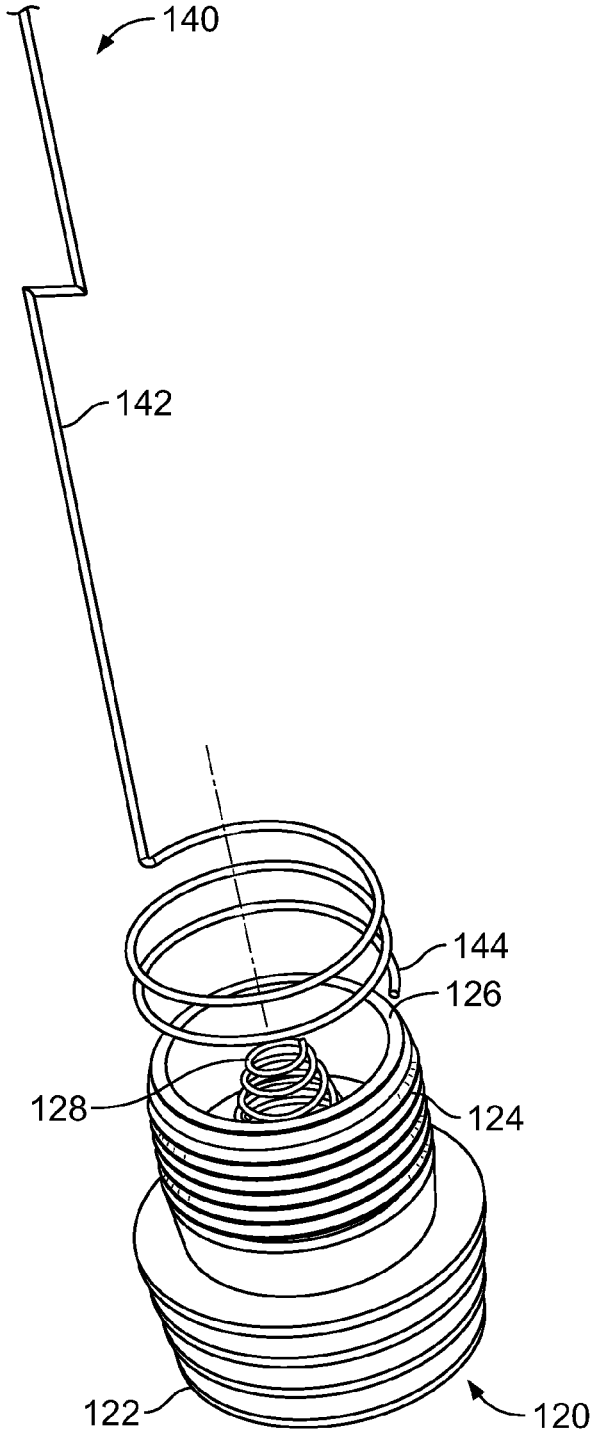
FIG. 2 shows a perspective view of a portion of a flameless candle, according to an embodiment of the present invention.

FIG. 2 shows a perspective view of a portion of the flameless candle, according to an embodiment of the present invention. The first electrical conductor 140 may include a vertical portion 142 and a horizontal portion 144. The first conductor 140 may be formed from one piece of wire, such as solid wire. The horizontal portion 144 may be located at the bottom of the vertical portion 142. The horizontal portion 144 may include a plurality of loops. Such loops may act as a spring.

The cap 120 may include a mating portion 124 and a mounting portion 122. The mounting portion 122 may adapt the flameless candle 100 to mount in a candleholder. The mating portion 124 may include male threads that mate with female threads on the shell 110. The cap 120 may also include a second electrical conductor 126. The second conductor 126 may include a rim 126, a recessed area and a spring 128.

Figures 3A, 3B, 3C:
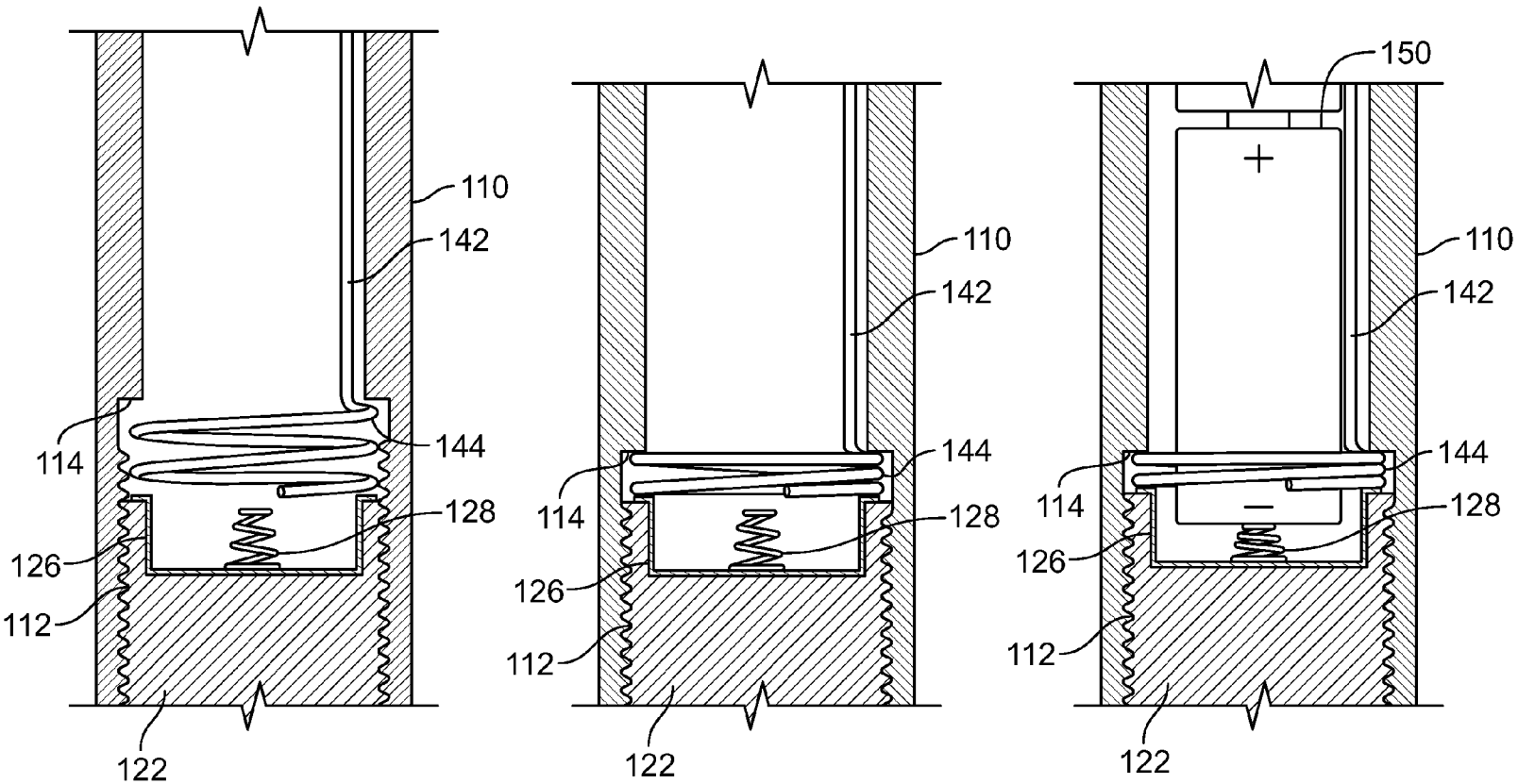
FIGS. 3A-3C show cross-sectional views of a portion of a flameless candle, according to an embodiment of the present invention.

FIGS. 3A-3C show cross-sectional views of a portion of a flameless candle, according to an embodiment of the present invention. FIG. 3A illustrates a situation where no battery is present and the mating portion 124 of the cap 120 has been only partially mated with the female threads 112 of shell 110. There is no contact between the horizontal portion 144 of the first conductor 140 and the second conductor 126.

Although not shown, the vertical portion 142 may be received by a groove in the inner wall of the shell 110. Using such a configuration, it may be possible to maintain the orientation of the first conductor 140 in a more stable manner. It also may be possible to prevent the vertical portion 142 from interfering with the side of the batteries 150, for example, during insertion of the batteries 150.

FIG. 3B illustrates a situation where no battery is present and the mating portion 124 of the cap has been fully mated with the female threads 112 of the shell 110. The second conductor 126 now makes contact with the horizontal portion 144. This contact can be enhanced by compressing the horizontal portion 144 between the rim of the second conductor 126 and a projecting portion 114 of the shell 110. Furthermore, if the horizontal portion 144 has a spring (as shown with loops), this may further improve the contact.

FIG. 3C illustrates a situation where a battery is present and the mating portion 124 of the cap has been fully mated with the female threads 112 of the shell 110. The spring 128 of the second conductor 126 is now contacting the negative terminal of the battery 150. Compressible nature of the spring 128 helps improve this contact. Thus, FIG. 3C in conjunction with FIG. 1B illustrate that the flameless candle 100 completes a circuit between the lamp 170 and the batteries 150 by having the compressed spring 128 contact the most distal terminal of the batteries 150. The spring 128 is part of the second conductor 126. The horizontal portion 144 of the first conductor is then compressed between the projecting portion 114 of the shell 110 and the rim of the second conductor 126. Current will now flow from the lamp 170, through the vertical portion 142 of the first conductor 140, through the rim of the second conductor 126, through the spring 128 of the second conductor, and to the distal terminal of the battery 150.

While the invention has been described with reference to certain embodiments, it will be understood by those skilled in the art that various changes may be made and equivalents may be substituted without departing from the scope of the invention. For example, the disclosed techniques may be applicable to other electronic devices, such as flashlights. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. An electronic device comprising:

a shell including an opening arranged to receive at least one battery into a hollow interior region of the shell;

a first electrical conductor located at least partially in the shell and including:

a vertical portion, and a horizontal portion at a bottom of the vertical portion;

a cap configured to mate with the shell through the shell opening and including a second electrical conductor; and wherein:

the horizontal portion of the first electrical conductor is configured to contact the second electrical conductor when the cap is mated with the shell, an inner wall of the shell comprises a projecting portion above the horizontal portion of the first electrical conductor, and the projecting portion of the shell and the second electrical conductor of the cap are configured to compress the horizontal portion when the cap is mated with the shell.

2. The electronic device of claim 1, wherein the horizontal portion of the first electrical conductor comprises a plurality of loops.

3. The electronic device of claim 1, wherein the second electrical conductor of the cap comprises a spring configured to contact a battery terminal when the cap is mated with the shell.

4. The electronic device of claim 1, wherein:

the cap comprises male threads; and the shell comprises female threads configured to mate with the male threads of the cap.

5. The electronic device of claim 1, wherein:

the second electrical conductor of the cap comprises a recessed area and a rim; and the rim of the second electrical conductor is configured to contact the horizontal portion of the first electrical conductor.

6. The electronic device of claim 1, wherein the shell is configured to house at least two batteries in series.

7. The electronic device of claim 1, wherein the inner wall of the shell comprises a groove configured to receive the vertical portion of the first electrical conductor.

8. The electronic device of claim 1, wherein the first electrical conductor is one piece of solid wire.

9. The electronic device of claim 1, further comprising an electronics portion connected to a top of the vertical portion of the first electrical conductor.

10. The electronic device of claim 9, wherein the electronics portion comprises a lamp.

11. An electronic device comprising:

a first electrical conductor located at least partially in a shell and including:

a vertical portion, and a horizontal portion at a bottom of the vertical portion; and wherein:

the horizontal portion of the first electrical conductor is configured to contact a second electrical conductor of a cap when the cap is mated with the shell, an inner wall of the shell comprises a projecting portion above the horizontal portion of the first electrical conductor, and the projecting portion of the shell and the second electrical conductor of the cap are configured to compress the horizontal portion when the cap is mated with the shell.

12. The electronic device of claim 11, wherein the horizontal portion of the first electrical conductor comprises a plurality of loops.

13. The electronic device of claim 11, wherein the second electrical conductor of the cap comprises a spring configured to contact a battery terminal when the cap is mated with the shell.

14. The electronic device of claim 11, wherein:

the second electrical conductor of the cap comprises a recessed area and a rim; and the rim of the second electrical conductor is configured to contact the horizontal portion of the first electrical conductor.

15. The electronic device of claim 11, wherein the inner wall of the shell comprises a groove configured to receive the vertical portion of the first electrical conductor.

* * * * *